US006132270A

United States Patent [19]

Nagel

[11] Patent Number: 6,132,270

[45] Date of Patent: Oct. 17, 2000

[54] PULSING REACTION DRIVE FOR WATER CRAFT

[75] Inventor: Edmund Ferdinand Nagel, Feldkirch, Austria

[73] Assignee: Siegfried Nagel, Egg, Austria

[21] Appl. No.: 09/214,269

[22] PCT Filed: Jun. 26, 1997

[86] PCT No.: PCT/AT97/00142

§ 371 Date: Dec. 31, 1998

§ 102(e) Date: Dec. 31, 1998

[87] PCT Pub. No.: WO98/01338

PCT Pub. Date: Jan. 15, 1998

[30] Foreign Application Priority Data

Jul. 3, 1996 [AT] Austria ..... 1168/96

[51] Int. Cl.[7] ..... B63H 11/14

[52] U.S. Cl. ..... 440/45; 440/38; 60/221

[58] Field of Search ..... 440/45, 38; 60/221; 123/169 MG; 417/73

[56] References Cited

U.S. PATENT DOCUMENTS

| | | | |
|---|---|---|---|
| 3,060,682 | 10/1962 | Kemenczky | 60/221 |
| 3,271,947 | 9/1966 | Kemenczky . | |
| 4,057,961 | 11/1977 | Payne | 60/221 |
| 4,535,735 | 8/1985 | Yoshinaga et al. | 123/310 |
| 4,726,183 | 2/1988 | Gongwer | 60/221 |
| 5,417,057 | 5/1995 | Robey | 60/269 |

FOREIGN PATENT DOCUMENTS

| | | | |
|---|---|---|---|
| 230215 | 3/1963 | Austria . | |
| 1 044 839 | 11/1953 | France . | |
| 1 206 530 | 2/1960 | France . | |
| 11 22 403 | 2/1963 | Germany . | |
| 398 352 | 3/1966 | Switzerland . | |
| 450 946 | 1/1968 | Switzerland . | |
| 700393 | 12/1953 | United Kingdom | 440/45 |
| 1 232 171 | 5/1971 | United Kingdom . | |

*Primary Examiner*—S. Joseph Morano
*Assistant Examiner*—Andrew D. Wright
*Attorney, Agent, or Firm*—Wenderoth, Lind & Ponack, L.L.P.

[57] ABSTRACT

This invention concerns an internal combustion engine with a combustion chamber (8) for burning the working gas in an explosion stroke and, connected to the combustion chamber (8), a pump chamber (18) which can be filled via an input orifice (181) with a driving fluid which can be ejected through an exhaust orifice (182) by the effect of the combustion gas formed during the explosion stroke; this internal combustion engine is provided with a spraying device (19, 50) with which a coolant can be sprayed into the pump chamber (18) during an implosion stroke subsequent to the explosion stroke.

33 Claims, 10 Drawing Sheets

PULSING REACTION DRIVE FOR WATER CRAFT

BACKGROUND OF THE INVENTION

The invention concerns a combustion motor having a combustion chamber for the combustion of the working gas during communication with combustion chamber. The pump chamber can be an explosion phase and a pump chamber which is in communication with combustion chamber. The pump chamber can be filled with a drive fluid by way of an inlet opening, and then can have the drive fluid expelled out of an outlet opening under the action of the combustion gas formed during the explosion phase.

A combustion motor of this kind is known for example from Swiss patent specification No 450 946 and is referred to therein as a reaction motor which can be used for example for driving water craft. In such motors the fluid in the pump chamber represents a kind of a fluid piston which is to be expelled as a whole from the pump chamber by the pressure of the combustion gas.

The known combustion motors of this kind suffer from the disadvantages inter alia of the relatively low level of efficiency of the machine and the low numbers of phases which can be achieved.

SUMMARY OF THE INVENTION

The object of the present invention is to provide an improved combustion motor of the kind set forth in the opening part of this specification.

By virtue of a cooling medium being injected into the pump chamber, the hot combustion gas is abruptly cooled down and as a result experiences a substantial reduction in its volume. The resulting reduced pressure now promotes conveyance of the next fluid piston into the pump chamber and desirably also promotes the conveyance of fresh working gas into the combustion chamber. That provides for a considerable reduction in the duration of the post-filling phase and enhances the level of efficiency of the combustion motor.

A certain implosion also occurs after the explosion phase in conventional combustion motors, but this takes place substantially more slowly and is less highly pronounced as heat exchange with respect to the combustion gas occurs only slowly and incompletely.

Further advantages and details of the invention are described hereinafter with reference to the accompanying drawing in which:

DETAILED DESCRIPTION OF THE PREFERRED EMBODIMENTS

Figure 1:
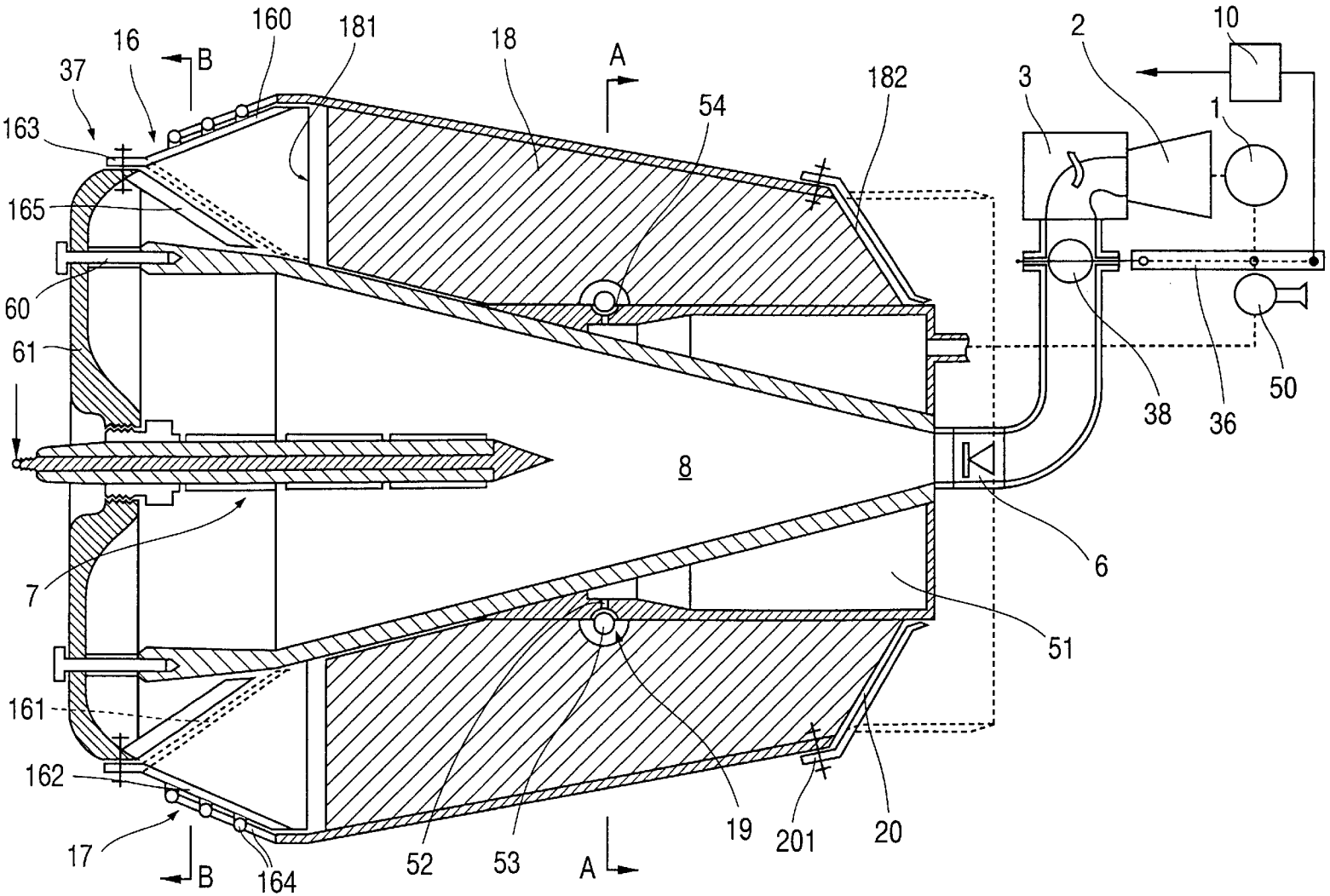
FIG. 1 shows a first embodiment of the invention, partly in the form of a longitudinal section and partly in the form of a diagrammatic view.
Figure 2:
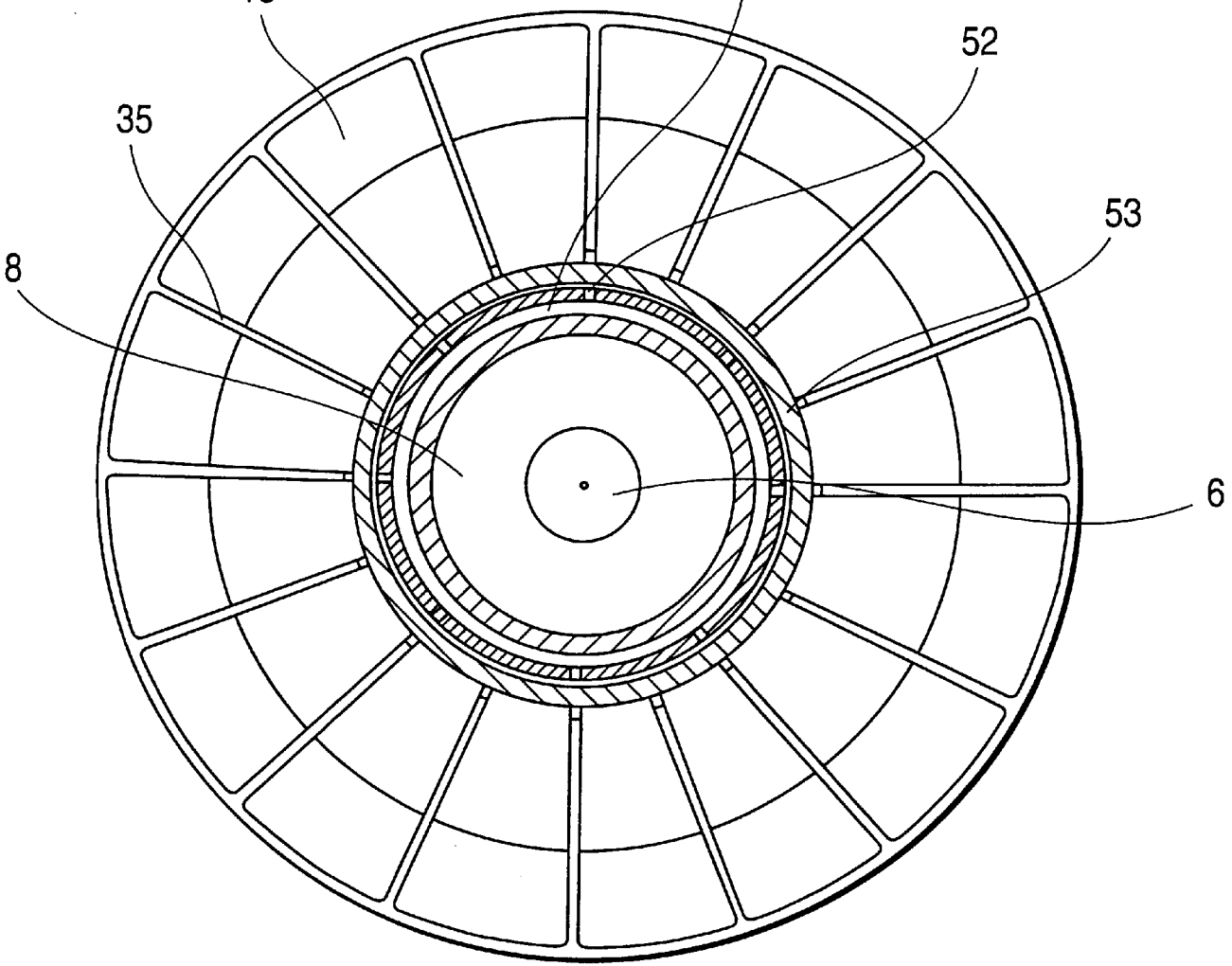
FIG. 2 is a view in cross-section taken along line A—A in FIG. 1.
Figure 3:
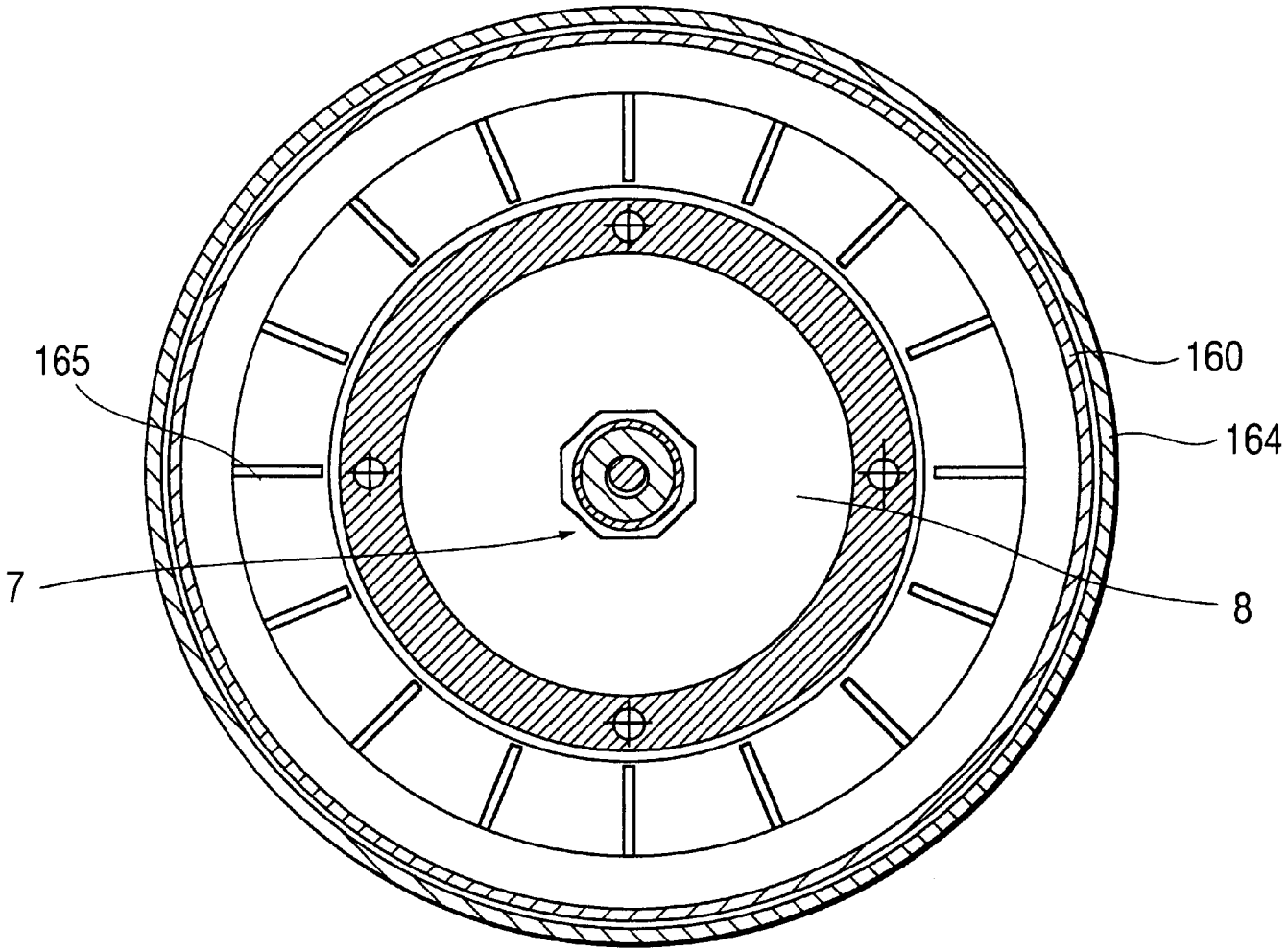
FIG. 3 is a view in cross-section taken along line B—B in FIG. 2.

Referring to FIGS. 1 through 3, shown therein is a first embodiment of the invention in which a multiplicity of pump chambers 18 are arranged generally in an annular array around a combustion chamber 8. In this case the individual pump chambers 18 are separated from each other by radial partitions 35. A working gas which is capable of exploding is fed to the combustion chamber 8 by way of the combustion chamber check valve 6, a combustion chamber inlet valve 38 and a carburetor 3. For initial ignition when starting the motor, the working gas is conveyed into the combustion chamber 8 by way of the delivery pump 2, which is driven by the drive motor 1. Immediately after initial ignition the delivery pump 2 becomes non-functional as the following charges for the combustion chamber 8 are conveyed by the reduced pressure in the pump chambers 18, as will be described hereinafter. The delivery pump 2 is preferably in the form of an axial pump that provides the required charge pressure for first filling of the combustion chamber 8 at relatively low speeds of rotation of the electric motor 1, and then remains inactive during normal operation of the motor, it builds up scarcely any flow resistance into the combustion chamber relation to the combustion air which is being sucked in.

The combustion chamber check valve 6 must withstand the high initial pressures during the explosion phase and prevent the combustion gas from escaping through the carburetor 3. In addition, the check valve 6 must be resistant to heat and must involve a low mass with respect to its movable parts in order to be able to follow high cycle frequencies without involving a troublesome delay. Accordingly a conventional valve with spring steel diaphragms is suitable as the check valve 6.

The combustion chamber 8 is of an elongate structural configuration, whereby the flushing characteristic is improved and a mixing effect between combustion gas from the preceding explosion phase and fresh working gas is kept at a particularly low level. As the working gas is ignited in the combustion chamber 8 at atmospheric pressure, the gas burning speed is relatively low. Thus, were the gas to be ignited only at the burner head, the increased pressure resulting from combustion of fresh gas components in the proximity of the burner head would expel the remaining fresh gas charge into the pump chamber 18 more rapidly than the flame front could be propagated. For that reason, a multi-point igniter arrangement in the form of an igniter bar 7 is employed.

Figure 8:
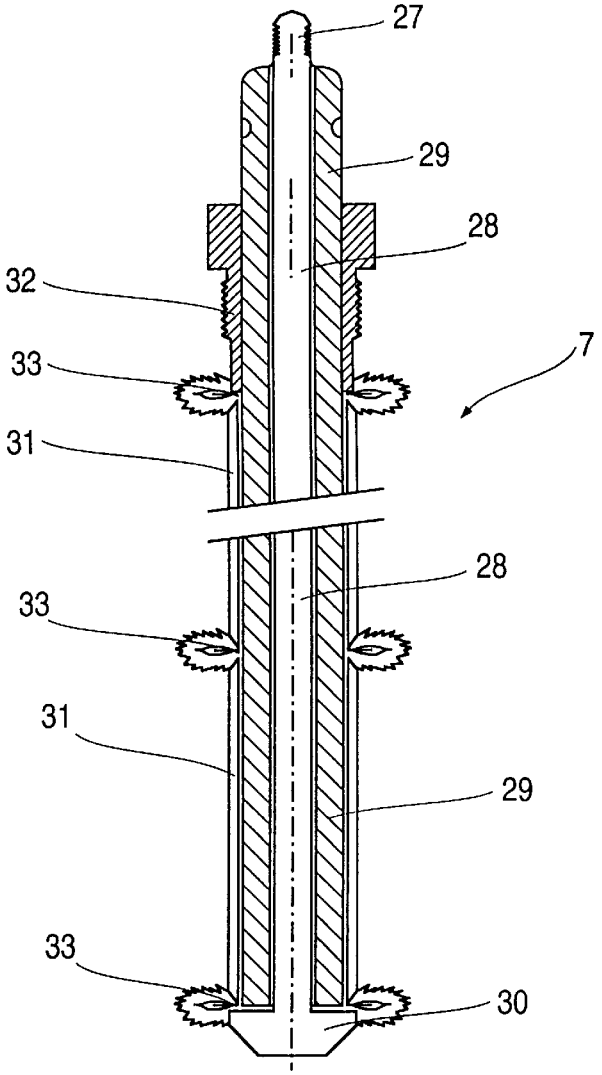
FIG. 8 is a detail view in longitudinal section of an igniter bar.

Such an igniter bar is shown for example in FIG. 8. The igniter bar 7 has a central electrode 28, at one end of which is disposed the connection 27 for the igniter cable and at the other end of which is disposed the electrode base 30. The electrode 28 is surrounded from its connection 27 to its base 30 by a tubular insulating body 29. That insulating body 29 is electrically nonconducting and is heat-resistant. An outer metal tube 31 surrounds the insulating body 29 and is provided between the electrode base 30 and the screwing-in thread 32 on the igniter bar, which screwing—a thread 32 extends around the insulating body in the proximity of the connection 27 for the igniter cable and which serves as an electrical counterpart pole. Provided within the outer tube 31 are a plurality of interruptions 33 which serve as series-connected spark gaps. The working gas is simultaneously ignited at a plurality of locations in the combustion chamber 8 by the sparks which are formed at the spark gaps during the ignition phase, so that the burning time of the entire gas charge is substantially reduced.

Should the igniter bar 7 be damp in the starting phase, various measures can be provided in order to remove such moisture. For example provision can be made for a heating device or a drying device using an air flow maybe employed.

Figure 11A:
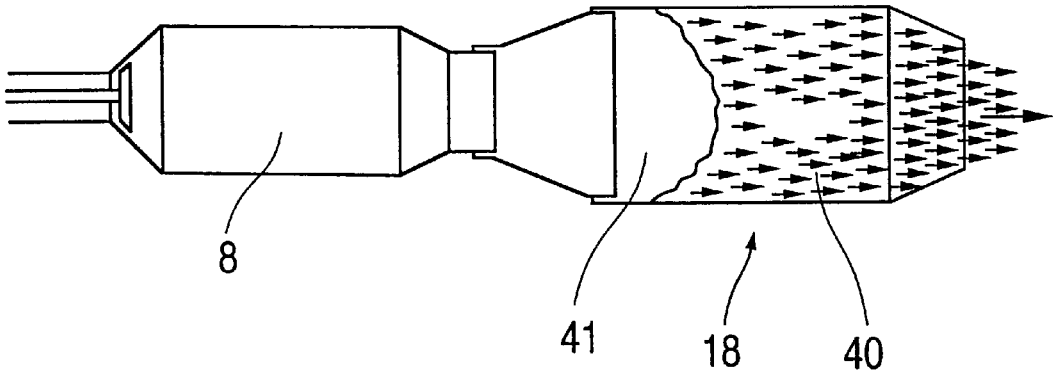
FIGS. 11*a* and 11*b* are diagrammatic views of a tubular piston flow and a piston bubble flow.
Figure 11B:
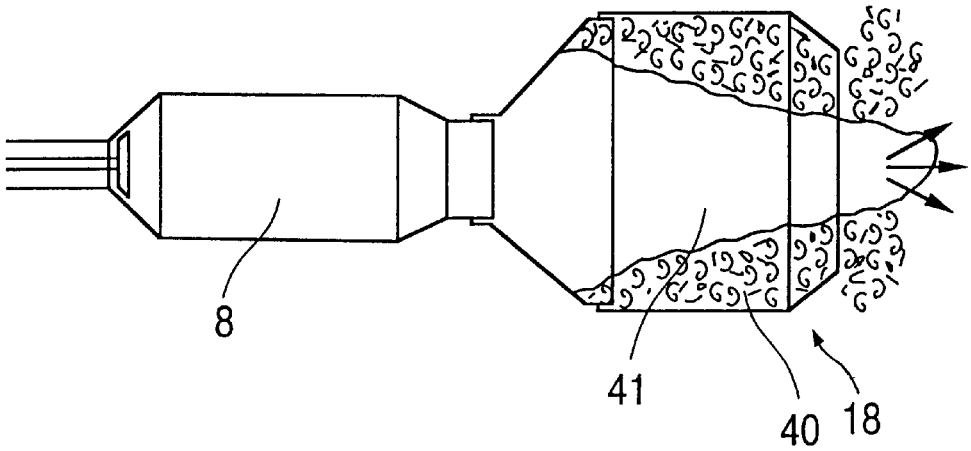

The combustion gas which is formed during the explosion phase and which is under an increased pressure flows through the head diffuser 37 and the inlet valve 16 into the pump chambers 18 and expels the working fluid therein out of the pump chamber outlet opening 182. In that respect it is important that the combustion gas expels the fluid in the pump chambers 18 in a so-called tubular piston flow and not for example in a so-called piston bubble flow. Such tubular piston flows are characterized by Baker (in Dubbel, "Maschinenbau", Springer), and the difference between those two kinds of flow will be briefly clarified with reference to FIGS. 11*a* and 11*b*. FIG. 11*a* illustrates a tubular piston flow in which the drive fluid 40 in the pump chamber 18 is expelled as a whole or in the form of a "fluid piston" by the combustion gas 41 which is formed in the combustion chamber 8. In FIG. 11*b* the gas 41 breaks through the surface of the fluid, whereby the fluid piston is not entirely expelled from the pump chamber and severe turbulence phenomena occur. The consequence is a drastic reduction in the level of efficiency.

Which of the two kinds of flow is formed depends in particular on the diameter of the pump chamber, its length and the viscosity of the fluid. In order to ensure that a tubular piston flow is formed, the pump chamber may not be less than a given length, when the pump chamber is of a predetermined diameter. Conventional combustion motors have only one pump chamber, which therefore must be relatively long overall in terms of its effective length, that is to say over the length that the combustion gas acts on the drive fluid. The consequence of this is that the times required to expel the fluid piston and to re-charge the motor with a new fluid piston are also relatively long. It is therefore only possible to achieve relatively low numbers of cycles of the motor.

In accordance with a first aspect of the invention it is provided that combustion gas formed in the combustion chamber 8 is distributed to a plurality of pump chambers 18. By virtue of the smaller area radius thereof or by virtue of the smaller cross-sectional thereof they can be of a shorter configuration, while retaining the tubular piston flow, whereby the number of phases or operating cycles of the motor can be increased. In that connection the total volume of the pump chambers 18 is so selected that the sum of the volume of the combustion chamber and the pump chambers approximately corresponds to the volume (in practice it is somewhat greater) of the combustion gas after it has expelled the working fluid out of the pump chambers 18 and has dropped to approximately atmospheric pressure again. In that way the working capacity of the combustion gas can be converted as completely as possible. It will be seen from these considerations that the number of pump tubes must be increased in squared relationship to their reduction in length.

After the end of the explosion phase a reduction in the volume of the combustion gas begins, as a result of its cooling down. The resulting reduced pressure in the pump chamber 18 is already used in the conventional combustion motors in the state of the art to convey the next working gas charge into the combustion chamber 8. A further factor which also results in a reduced pressure in the pump chambers towards or after the end of the explosion phase in the conventional fluid piston combustion motors is the kinetic energy of the water piston as it flows away.

In comparison therewith, the present invention goes a step further and there is provided a spray device with which a cooling medium can be sprayed into the pump chamber 18 at the end of the explosion phase. In that respect the spray device can be provided irrespective of the number of pump chambers. Due to the cooling medium being sprayed into the pump chambers 18, the volume of the combustion gas is abruptly reduced and an implosion phase subsequent to the explosion phase is implemented.

The spray device has a series of spray nozzles 19 which open into the individual pump chambers 18 and which are connected to a cooling medium chamber 51. The cooling medium chamber 51 is arranged between the combustion chamber 8 and the pump chambers 18 in an annular configuration around the combustion chamber 8 and can be acted upon by a pressure created by a cycle pump 15. Bores 52 are provided between the cooling medium chamber 51 and the pump chambers 18 to form the spray nozzles 19. On the side of the pump chambers 18 those bores 52 are connected by an annular V-shaped groove 54 in which a sealing ring 53 in the form of an O-ring is clamped. When the cooling medium 51 is put under pressure by the pump 50 the cooling medium is sprayed by way of the spray nozzles 19 into the pump chambers 18 primarily in the longitudinal direction thereof. The cooling medium used is preferably the same fluid as that which also forms the drive fluid, for example water, particularly when the combustion motor is used as a boat drive.

The reduced pressure which is caused by spraying in the cooling medium in the pump chambers causes the outlet valve 20, which is in the form of a check valve, to close. The outlet valve 20 is provided jointly for all pump chambers 18 and comprises an elastic truncated tube portion of which one edge region 201 is secured to a region, adjacent to the outlet openings 182 of the pump chambers 18, of the wall of the pump chambers 18, and which is prestressed towards the closed position. The magnitude of that prestressing towards the closed position is so selected that the outlet valve 20 already closes when the water piston has been completely expelled from the respective pump chamber 18 and only combustion gas is still flowing hereafter. The outlet valve 20 can therefore close off pump chambers 18 in which gas prematurely reaches the valve and therefore acts in a synchronising mode and prevents gas from escaping prematurely from the pump chamber. As the diaphragm of the outlet valve is very light, the valve closes and opens with only a short time delay and is therefore also suitable for a fast working cycle.

Due to the reduced pressure in the pump chambers 18 the inlet valve 16 further opens the drive fluid inlet opening 17, that is to say the valve flap 160 moves from its second closed position 162 in the direction of the first closed position 161. By virtue thereof, drive fluid, for example water, can flow through the drive fluid inlet opening 17 into the rear part of the head diffuser 37 and further through the inlet openings 181 of the pump chambers 18 into the pump chambers 18.

During the explosion phase or at the beginning of the implosion phase the combustion chamber inlet valve 38, which is for example in the form of a flap valve, has been opened by the control device 36. Therefore, due to the reduced pressure in the pump chambers 18 during the implosion phase combustion gas is also conveyed out of the combustion chamber 8 and fresh working gas flows thereafter. The valve flap 160 of the inlet valve 16 is therefore in an intermediate position between the second closed position 162 and the first closed position 161, and a mixture of working fluid and combustion gas flows into the pump chambers 18. If the combustion gas formed in the next explosion phase were to encounter such a mixture of drive fluid and combustion gas, the combustion gas could penetrate into that fluid piston which is permeated with gas, and clean expulsion of the fluid piston would be prevented. In order to counteract this, the combustion chamber inlet valve 38 is closed prior to the end of the water piston trailing flow or wake so that the subsequent trailing flow of gas out of the combustion chamber 8 is stopped, whereby the inlet valve 16, which is described hereinafter, is moved into the first closed position 161 and no gas is mixed with the head of the water piston. At the time at which the valve 38 is closed, the procedure for flushing the combustion chamber 8 with fresh gas should as far as possible just be brought to a close. In the next explosion phase therefore the combustion gas formed impinges on pure drive fluid and the head of the fluid piston in the respective pump chamber 18 is gas-tight in relation to the combustion gas.

The reduced pressure obtaining in the pump chambers 18 during the implosion phase therefore already accelerates the fluid piston forwardly in the expulsion direction. The thermal energy stored in the exhaust or waste gas is therefore completely used, on the one hand for the acceleration effect and for post-charging of the fluid piston, and on the other hand for flushing the combustion chamber 8. The reduced pressure obtained in the pump chambers 18 during the implosion phase is compensated by the inflowing fluid piston before the pump chambers 18 are entirely filled with drive fluid. The last phase in the filling procedure during which the outlet valve 20 opens is implemented by the kinetic energy of the forwardly accelerated fluid piston. When the motor is already moving, that is to say either it is moving with respect to the drive fluid or—in the closed fluid circuit—the drive fluid forms an afflux flow to the motor, that afflux flow of the drive fluid to the drive fluid inlet opening 17 also provides a supporting effect in terms of re-charging of the pump chambers with drive fluid and flushing of the combustion chamber 8.

An important aspect of the invention, which can also be implemented independently of the other aspects, is the particular configuration of the inlet valve 16. More specifically, it is necessary to prevent the combustion gas which flows out of the combustion chamber 8 during the explosion phase flowing tangentially past a drive fluid surface since, from by virtue thereof, drive fluid would be entrained by the combustion gas and it would be so-to-speak sprayed into the combustion gas. However, the fact of drive fluid being sprayed into the combustion gas in that way would result in a cooling effect and a reduction in the volume of the combustion gas while the explosion phase is still taking place. The consequence of this would be a substantial reduction in the level of efficiency of the motor. In accordance with this aspect of the invention the inlet valve 16 for the combustion gas is arranged at or—as viewed in the direction of flow of the combustion gas—upstream of the end of the pump chambers 18, that is opposite to the outlet openings 182 of the pump chambers 18. Thus, the arrangement and configuration of the inlet valve 16 for the combustion gas is such that the combustion gas which flows out of the combustion chamber 8 impinges essentially only in frontal relationship onto the drive fluid.

In principle the inlet valve 16 for the combustion gas to pass into the pump chambers 18, and an inlet valve for the drive fluid to pass into the pump chambers 18 could be provided separately. It is preferred however to provide a common inlet valve 16 for the combustion gas and for the drive fluid, as is shown in FIGS. 1 through 3. The valve flap 160 of this inlet valve 16 closes off the combustion chamber 8 in a first closed position 161, and closes off the drive fluid inlet opening 17 in a second closed position 162. That second closed position 162 is adopted in the event of an increased pressure in the combustion chamber 8 or in the head diffuser 37. The valve flap 160 is formed from an elastic truncated tube portion, which for example can comprise silicone. The one edge region 163 of that truncated tube portion is secured to the outside wall of the motor, and while in the first closed position 161 the other edge region bears against the wall of the head diffuser 37, which is on the inside of the motor, and while in the second closed position 162 it bears against the wall of the head diffuser 37 which is on the outside of the motor. The truncated tube portion is prestressed in the first closed position 161 by virtue of its elasticity. Support elements 164, 165 are provided to support the truncated tube portion in the two closed positions 161, 162; the support elements 164, 165 can be, for example, grills or strip-shaped elements which are oriented in the direction of flow of the respective medium.

The sequence of the explosion and implosion phases is controlled by the control device 36, which can be for example in the form of a cam control system. For ignition of the igniter bar 7 the control device 36 outputs a signal to the electrical control system 10 which includes the ignition coil. The pump 50 is set in operation by the control device 36 for spraying cooling medium into the pump chambers. In that case, the energy consumed by the pump 50 corresponds to less than 1 percent of the total energy and is therefore not significant. In addition the control device 36 opens and closes the combustion chamber inlet valve 38.

As the implosion phase must immediately follow the explosion phase even when the machine is running slowly or idling, the control device 36 controls an idle mode by pause phases being inserted after the implosion phase during the idle mode. During those pause phases drive fluid which flows in afflux relationship to the motor can simply flow through the pump chambers 18.

The head diffuser 37 which takes the communication between the combustion chamber 8 and the pump chambers 18 and in which the inlet valve 16 and the drive fluid inlet opening 17 are disposed enlarges in a conical configuration from the combustion chamber, and its function is to reduce the speed of the working gas issuing from the combustion chamber. The conical shape of the combustion chamber assists with that function whereby the length of the head diffuser can be reduced.

The pump chambers 18 are also of a conical structural shape, and more specifically their cross-sectional area decreases from their inlet opening 181 to their outlet opening 182. By virtue of that configuration, with a reference size with respect the outlet opening 182, the area of the inlet opening can be increased, whereby the possible number of phases or cycles can be maximized as the water feed takes place more quickly and the pump chamber length can be reduced.

By releasing the connecting bolts 60 the front plate 61 of the combustion chamber 8 can be removed and access to the combustion chamber 8 can be afforded.

The mode of operation of the embodiment illustrated in FIGS. 4 through 9 is in principle the same and similar parts have been denoted by the same references. In this embodiment the motor is used as a boat drive and is therefore arranged on a boat bottom 9 beneath the water line 26. Unlike the embodiment illustrated in FIGS. 1 through 3, the pump chambers 18 are not arranged around the combustion chamber 8 but in series in relation thereto. For that purpose the combustion gas which flows out of the combustion chamber 8 is distributed in a gas distributor 14 to a plurality of gas distributor or manifold pipes 15. Provided between the gas distributor pipes 15 and the pump chambers 18 there are again inlet valves 16 which can close off the access to the gas distributor pipes 15, and also close off the drive fluid inlet openings 17. Those inlet valves 16 are shown on an enlarged scale in FIG. 6 and are similar in terms of their structure and function to the inlet valves of the embodiment shown in FIGS. 1 through 3, in which case however a separate inlet valve 16 is provided for each pump chamber 18.

Figure 7A:
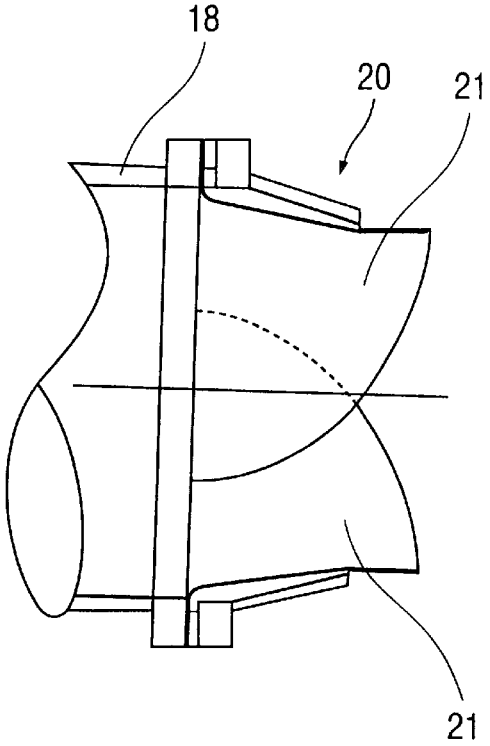
FIGS. 7*a* and 7*b* are detail views of an outlet valve from a side view (a) and a rear view (b)
Figure 7B:
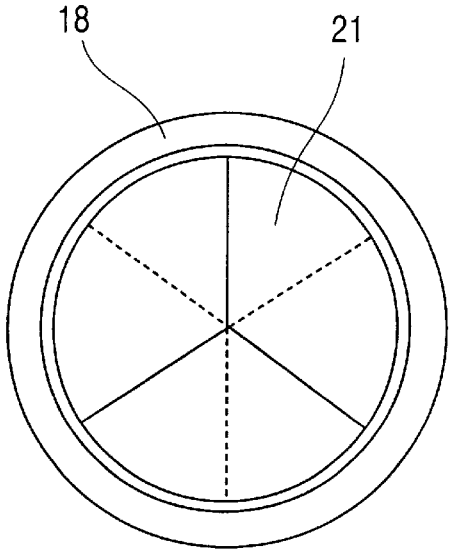

Each of the pump chambers 18 again has spray nozzles 19. In contrast to the embodiment shown in FIGS. 1 through 3 however the spray nozzles are not supplied by a pump but automatically open when there is a slightly reduced pressure of for example between 0.1 and 0.5 bar in the pump chambers. A reduced pressure of that kind occurs at the beginning of the implosion phase due to the combustion gas being cooled down and also due to the kinetic energy of the water piston as it is expelled. Once again, provided at the outlet end of the pump chambers 18 are outlet valves 20 which close in the event of a reduced pressure in the pump chambers 18. Those outlet valves 20, which in this embodiment are provided separately for each pump tube 18, are shown in FIG. 7 open at (a) and closed at (b). The outlet valve 20 has elastic diaphragms 21 in the form of segments of a circle, which in the closed condition overlap in shingle-like relationship in a similar manner to a leaf shutter of a camera. Supports (not shown in FIG. 7) at the end of the pump chamber 18 which preferably extend radially across the outlet of the pump chamber 18 in a star configuration prevent those diaphragms 21 from being inverted into the pump chamber 18 by virtue of a reduced pressure in the pump chamber 18. The segments of the circle come together to constitute a disk shape in front of the outlet end of the pump chamber 18 and shut off the return flow of water. The diaphragms 21 are also prestressed in that form so that they load the water piston during its passage through the valve, with the closing pressure. At the same time as the end of the water piston passes, the outlet valve 20 closes, extremely quickly by virtue of its small mass.

Figure 9:
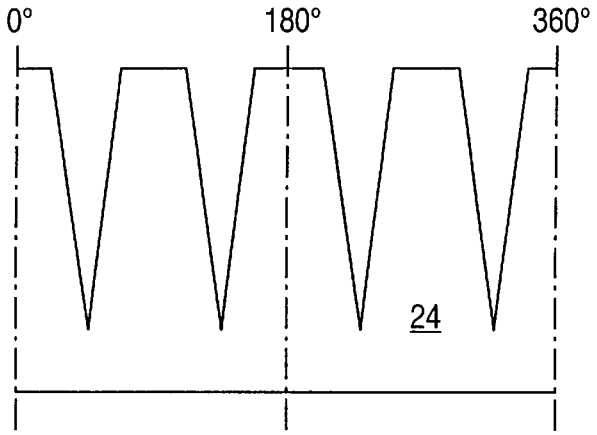
FIG. 9 is a detail view of an inner tube of an injector pump, shown in an unrolled condition.

As the speed of expulsion of the water piston out of the pump chamber 18 is substantially higher than the speed of the boat, that speed difference would markedly reduce the level of efficiency involved if the combustion motor were used directly as a boat drive. Therefore, connected downstream of the pump chambers 18 is an injector pump 23 which causes a reduction in speed with at the same time an increase in the volume of the expelled jet of water. The injector pump 23 has an inner tube 24 which is scalloped in a crown-like configuration and which is shown in FIG. 9 in a rolled-out condition. The inner tube 24 is surrounded by a flexible outer hose 25 which is resistant to tensile forces, and which is secured to the inner tube 24 on the side of the inlet opening thereof while its other side is free. Desirably, the outer hose 25 enlarges in a slightly conical configuration in the closing direction. When the water piston issues from the pump tubes 18, the outer hose 25 is sucked by the reduced pressure into the scallop recesses of the inner tube 24, thereby forming a conical jet tube. Depending on the duration and configuration of the reduced pressure or reduced-pressure regions within the inner tube 24, the outer hose 25 is sucked in over a varying length. In the pauses between ejection of the individual water pistons from the pump chambers 18, the outer hose 25 is released and can adapt itself to the flowing water in a freely fluttering manner and in an advantageous configuration in terms of flow. In the event of shock waves occurring, the outer hose 25, which is of a slightly conically enlarging configuration, is inflated, whereby a shock wave can also be put to use to improve the forward drive effect.

The sequence in respect of time of ignition sparks and starting of the drive motor 1 in the start-up phase is implemented by the electrical control system 10. For that purpose, as input signals it receives the signal of a speed regulator 12 and the signal of a travel speed regulator 13 as the maximum possible cycle or phase rates depending on the speed of travel, and then it promotes re-charging of the fluid pistons into the pump chambers 18. The power supply for the electrical control system 10 is a battery 11.

Figure 4:
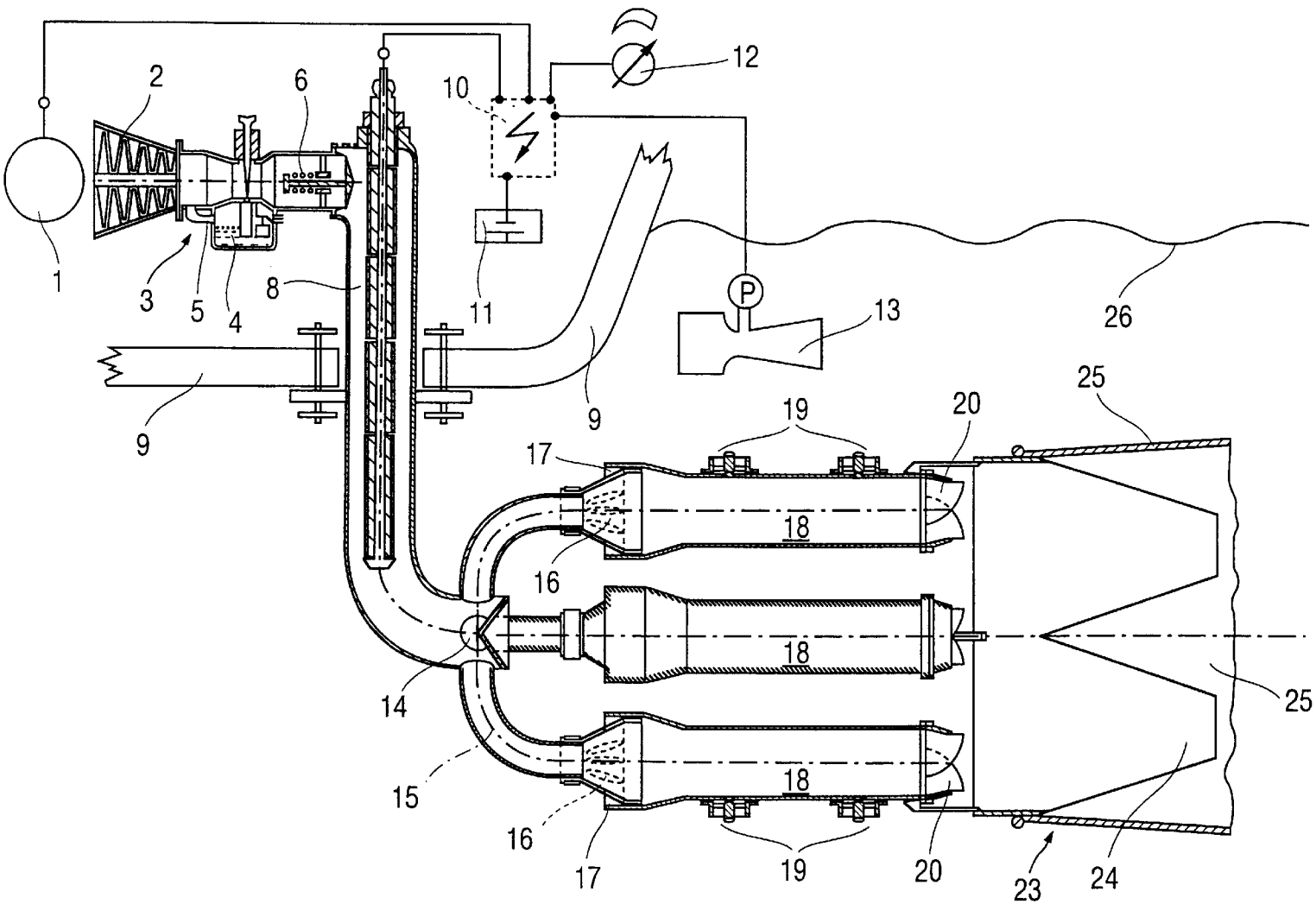
FIG. 4 is a view in longitudinal section through a second embodiment of the invention in the form of a boat drive.

FIG. 4 also shows the carburetor 3 in somewhat greater detail. It has a conventional float chamber 4 with fuel valve. In addition, extending from the float chamber 4 to the inlet opening of the carburetor 3 is a pressure-compensation duct 5 in order to compensate for the inlet pressure, which is above atmospheric pressure, in the start-up phase, in the chambers. Accordingly, fuel is also mixed with the air in the start-up phase in a mixture ratio which remains the same.

FIGS. 5*a* through 5*e* show a machine cycle, with fresh working gas 42, combustion gas 41 and drive fluid 40 being identified in different ways.

Figure 5A:
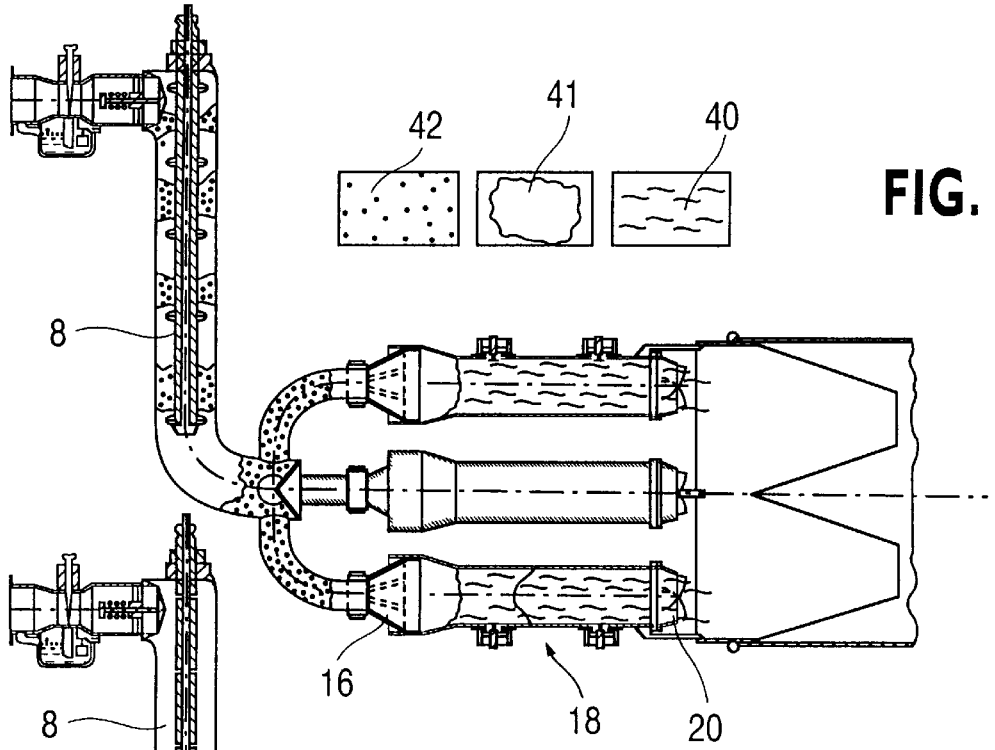
FIGS. 5*a*–5*e* are views of showing the operating procedure involved in a phase cylinder.

In FIG. 5*a* ignition has just occurred. A plurality of flame centers are being propagated, the inlet valve 16 is inflated, that is to say opened towards the combustion chamber 8, and closed towards the drive fluid inlet opening 17. The discharge flow valves 20 are opened and the water pistons begin to be expelled from the pump tubes 18.

Figure 5B:
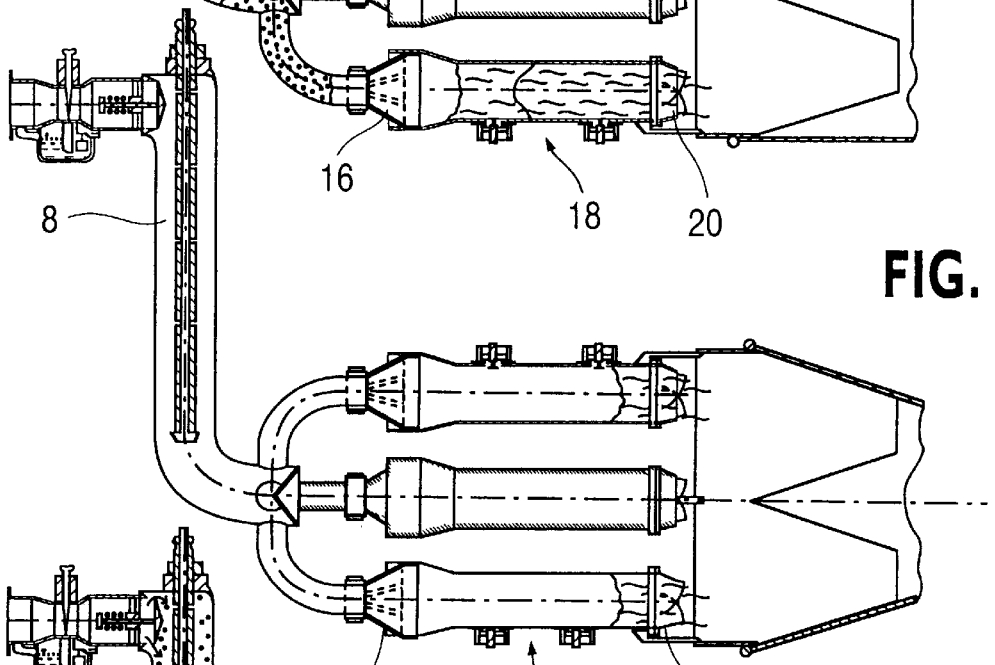

In FIG. 5*b* the explosion pressure has almost completely expelled the water pistons. From now on the departing water pistons implement an initial reduced pressure into the pump tubes. The combustible mixture is burnt without any residue.

Figure 5C:
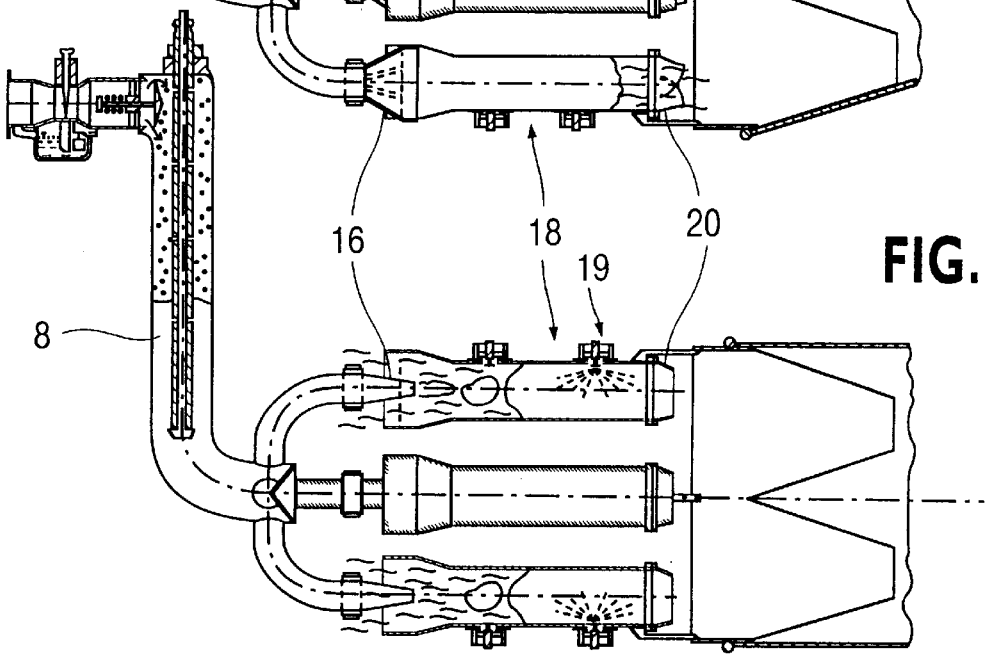

In the condition of the motor shown in FIG. 5*c* the explosion phase has already concluded and the implosion phase has begun. The initial reduced pressure has activated the spray nozzles 19 and they increase the reduced pressure by completely cooling the residual gas in the pump tubes. The outlet valves 20 are closed and the inlet valves 16 have opened the drive fluid inlet opening 17. New water pistons are sucked into the pump tubes and a fresh charge of combustible working gas is sucked into the combustion chamber 8.

Figure 5D:
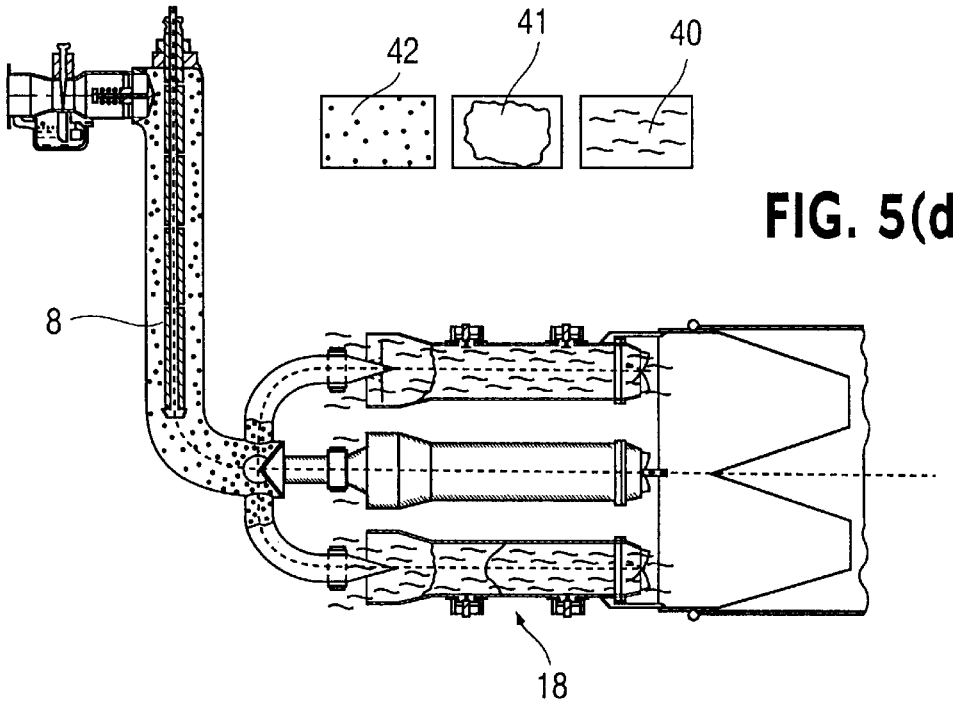

In the condition shown in FIG. 5*d* the pump chambers 18 are completely filled with a fresh water charge and likewise the combustion chamber is filled with combustible mixture. The next cycle can be fired.

Figure 5E:
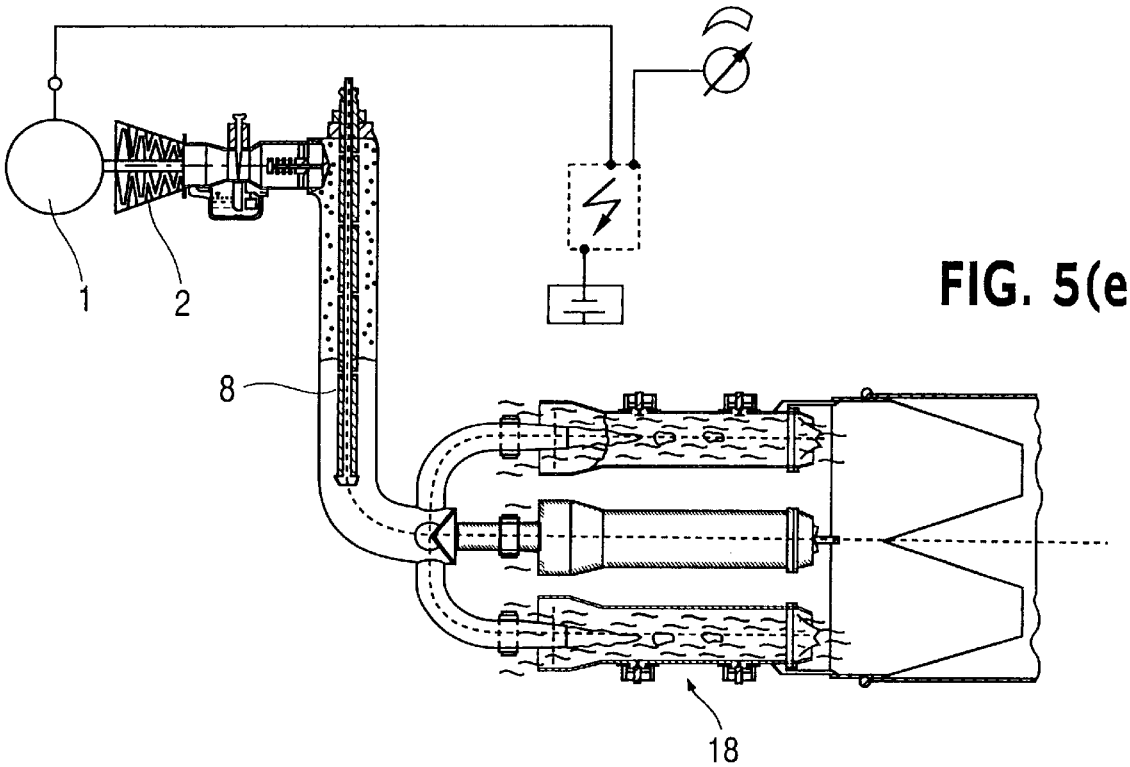
Figure 6:
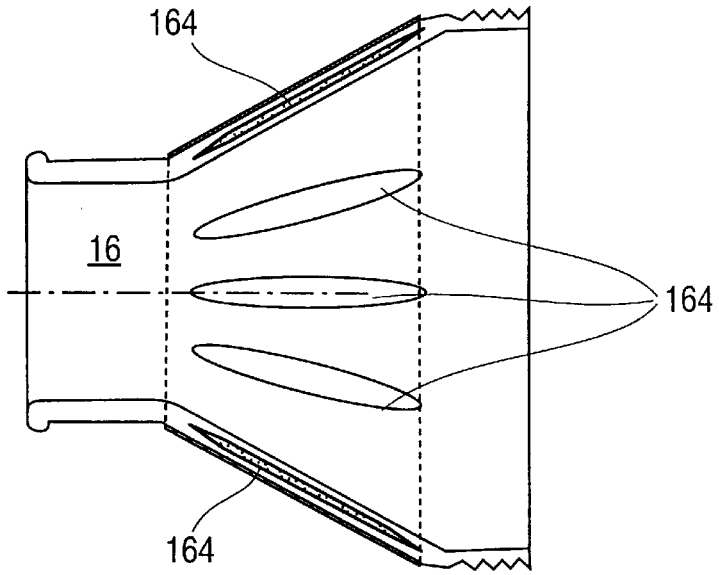
FIG. 6 is a detail view in longitudinal section of an inlet valve.

FIG. 5*e* also shows the starting phase of the motor. In this phase fresh gas is conveyed into the combustion chamber 8 by way of the axial pump 2 which is driven by the drive motor 1, in which case the gas in the combustion chamber (or the fluid therein) can issue through the pump chambers 18.

Figure 10:
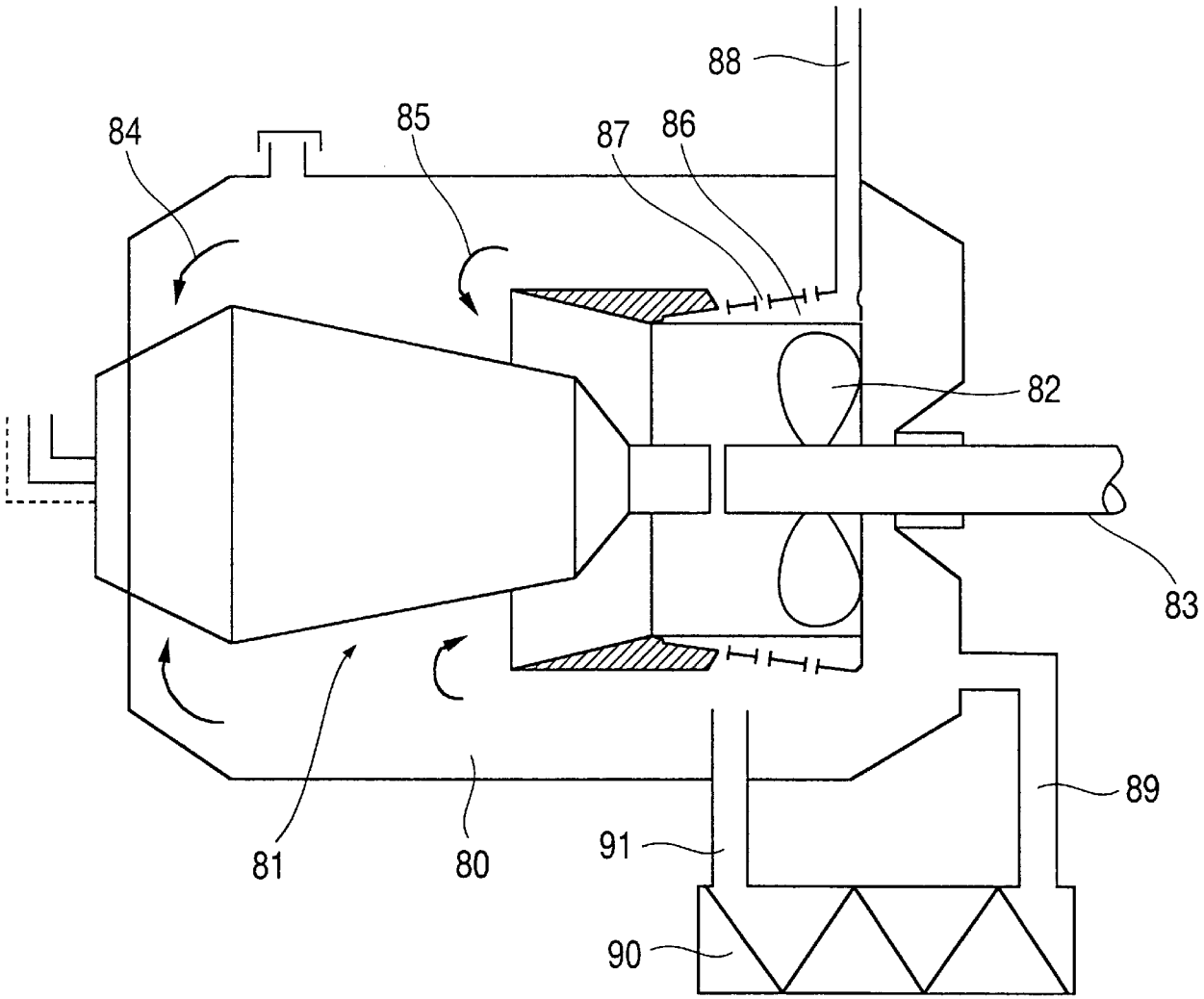
FIG. 10 is a diagrammatic view of a fluid impulsion circuit with a combustion motor according to the invention.

The drive arrangement shown in FIG. 10 has a fluid impulsion circuit 80 which is driven by a combustion motor 81 according to the invention. Arranged in the circuit is a flow turbine 82, preferably a Kaplan or Francis turbine, the rotation of which drives a drive shaft 83.

The fluid circuit has a large circulatory configuration and a small circulatory configuration. The large circulatory configuration is indicated by the arrows 84 and leads through the motor 81. In the motor the fluid is accelerated and consequently drives the turbine 82. If the inlet opening of the motor is closed the fluid can short-circuit the motor and can follow a small circulatory configuration corresponding to the arrows 85.

Arranged on a curve inside of the fluid circuit is an exhaust gas collecting chamber 86, through the inlet openings 87 of which can enter the combustion gas which accumulates in the reduced-pressure region on the curve inside and which can then escape through the exhaust 88.

Provided on a curve outside (increased-pressure region) is an inlet pipe 89 for a radiator 90. The drive fluid is cooled in the latter and is then returned to the fluid circuit through the outlet pipe 91, which opens at a curve inside (reduced-pressure region) of the fluid circuit.

What is claimed is:

1. A combustion motor, comprising:

a combustion chamber;

a pump chamber in fluid communication with said combustion chamber, the pump chamber having an inlet opening and an outlet opening;

an outlet valve associated with said outlet opening; and a spray device in communication with said pump chamber;

such that, combustion of a gas within said combustion chamber during an explosion phase expels a drive fluid from said pump chamber through said outlet opening while said outlet valve is open, then said spray device sprays a cooling medium into said pump chamber such that hot combustion gas contained therein is cooled and reduced to a sub-atmospheric pressure during an implosion phase while said valve closes said outlet opening and while drive fluid flows into said pump chamber through said inlet opening.

2. The combustion motor of claim 1, wherein said spray device includes a pump for the cooling medium.

3. The combustion motor of claim 1, wherein said spray device includes at least one spray nozzle provided in said pump chamber and configured to spray the cooling medium primarily in the longitudinal direction of said pump chamber.

4. The combustion motor of claim 1, wherein the volume of said combustion chamber combined with the volume of said pump chamber substantially corresponds to the volume of the combusted gas when at atmospheric pressure.

5. The combustion motor of claim 1, wherein said valve is a check valve which closes said outlet opening in response to the pressure in said pump chamber becoming sub-atmospheric as a result of the hot combustion gas therein being cooled by the cooling medium.

6. The combustion motor of claim 1, and further comprising a multi-point igniter device located within said combustion chamber for combusting the gas.

7. The combustion motor of claim 1, wherein said combustion chamber includes a gas inlet end and an opposite end, and wherein said combustion chamber is of a conical configuration that enlarges in cross-section from said gas inlet end towards said opposite end.

8. The combustion motor of claim 6, and further comprising a control device for actuating said multi-point igniter device and said spray device.

9. The combustion motor of claim 8, wherein said control device is for actuating said spray device immediately after the explosion phase.

10. The combustion motor of claim 8, wherein said control device is for actuating said spray device when the gas has returned to substantially atmospheric pressure.

11. The combustion motor of claim 8, wherein said control device is for actuating said multi-point igniter device after a pause after the implosion phase during an idle mode of operation of said combustion motor.

12. The combustion motor of claim 9, wherein said control device is for actuating said multi-point igniter device after a pause after the implosion phase during an idle mode of operation of said combustion motor.

13. The combustion motor of claim 1, and further including an inlet valve associated with said inlet opening, wherein during the explosion phase said inlet valve closes said inlet opening, and during the implosion phase said inlet valve opens said inlet opening.

14. A drive arrangement comprising:

a fluid impulsion circuit including a turbine; and a motor as set forth in claim 1 for driving said turbine.

15. The drive arrangement of claim 14, and further comprising a shaft which is driven by said turbine.

16. A drive arrangement comprising:

a fluid impulsion circuit including a turbine; and a motor as set forth in claim 2 for driving said turbine.

17. A drive arrangement comprising:

a fluid impulsion circuit including a turbine; and a motor as set forth in claim 3 for driving said turbine.

18. A drive arrangement comprising:

a fluid impulsion circuit including a turbine; and a motor as set forth in claim 4 for driving said turbine.

19. A drive arrangement comprising:

a fluid impulsion circuit including a turbine; and a motor as set forth in claim 5 for driving said turbine.

20. A drive arrangement comprising:

a fluid impulsion circuit including a turbine; and a motor as set forth in claim 6 for driving said turbine.

21. A drive arrangement comprising:

a fluid impulsion circuit including a turbine; and a motor as set forth in claim 7 for driving said turbine.

22. A drive arrangement comprising:

a fluid impulsion circuit including a turbine; and a motor as set forth in claim 8 for driving said turbine.

23. A drive arrangement comprising:

a fluid impulsion circuit including a turbine; and a motor as set forth in claim 9 for driving said turbine.

24. A drive arrangement comprising:

a fluid impulsion circuit including a turbine; and a motor as set forth in claim 10 for driving said turbine.

25. A drive arrangement comprising;

a fluid impulsion circuit including a turbine; and a motor as set forth in claim 11 for driving said turbine.

26. A method for operating a combustion motor, wherein the combustion motor includes:

a combustion chamber;

a pump chamber in fluid communication with said combustion chamber, the pump chamber having an inlet opening and an outlet opening;

An outlet valve associated with said outlet opening; and a spray device in communication with said pump chamber; and wherein the method includes the following steps:

supplying a drive fluid into said pump chamber;

supplying gas into said combustion chamber;

combusting said gas within said combustion chamber during an explosion phase, thereby causing said gas to be forced from said combustion chamber and into said pump chamber whereby said gas expels said drive fluid from said pump chamber through said outlet opening while said outlet valve is open; and then operating said spray device to spray a cooling medium onto the gas in said pump chamber, whereby said gas is cooled and reduced to a sub-atmospheric pressure during an implosion phase while said outlet valve closes said outlet opening and while drive fluid flows into said pump chamber through said inlet opening.

27. The method of claim 26, wherein said cooling medium is water.

28. The method of claim 26, wherein said spray device includes a pump and at least one spray nozzle, and wherein the step of operating said spray device includes operating said pump such that said cooling medium is forced through said at least one nozzle and along the longitudinal direction of said pump chamber.

29. The method of claim 26, wherein said outlet valve is a check valve, and wherein the closing of said outlet opening includes closing said outlet opening with said check valve in response to achieving the sub-atmospheric pressure.

30. The method of claim 26, wherein the combustion motor further includes a multi-point igniter device located within said combustion chamber, and wherein said combusting step comprises actuating said multi-point igniter device.

31. The method of claim 26, wherein said operating step is performed immediately after said combusting step.

32. The method of claim 31, wherein said operating step is performed when said gas has returned to substantially atmospheric pressure.

33. The method of claim 26, wherein said combustion motor further includes an inlet valve associated with said inlet opening, and further including the steps of closing said inlet opening with said inlet valve during said combusting step, and removing said inlet valve from said inlet opening during said operating step.

* * * * *